US006029920A

United States Patent [19]

Shimizu et al.

[11] Patent Number: 6,029,920

[45] Date of Patent: Feb. 29, 2000

[54] DISPERSING APPARATUS

[75] Inventors: Hideo Shimizu; Makoto Dohi, both of Tokyo, Japan

[73] Assignee: Toyo Ink Manufacturing Co., Ltd., Tokyo, Japan

[21] Appl. No.: 09/101,768

[22] PCT Filed: Nov. 22, 1996

[86] PCT No.: PCT/JP96/03441

§ 371 Date: Jul. 21, 1998

§ 102(e) Date: Jul. 21, 1998

[87] PCT Pub. No.: WO98/22220

PCT Pub. Date: May 28, 1998

[51] Int. Cl.[7] ..... B02C 17/16

[52] U.S. Cl. ..... 241/170; 241/172; 241/174; 241/179

[58] Field of Search ..... 241/170, 171, 241/172, 173, 174, 179

[56] References Cited

U.S. PATENT DOCUMENTS

| | | | |
|---|---|---|---|
| 3,199,792 | 8/1965 | Norris, Jr. | 241/30 |
| 4,673,134 | 6/1987 | Barthelmess | 241/57 |
| 4,919,347 | 4/1990 | Kamiwano et al. | 241/65 |
| 5,544,825 | 8/1996 | Stehr | 241/171 |

FOREIGN PATENT DOCUMENTS

| | | |
|---|---|---|
| 0587185 | 3/1994 | European Pat. Off. . |
| 1211904 | 3/1966 | Germany . |
| 3615491 | 11/1987 | Germany . |
| 1106760 | 3/1968 | United Kingdom . |
| 1486613 | 9/1977 | United Kingdom . |

*Primary Examiner*—John M. Husar
*Attorney, Agent, or Firm*—Oblon, Spivak, McClelland, Maier & Neustadt, P.C.

[57] ABSTRACT

It is an object to provide a continuous type dispersing apparatus arranged to disperse particle media in a vessel by stirring blades thereof to satisfactorily perform a process for dispersing a material to be dispersed to effectively use energy of the stirring blades to disperse pigment so as to reduce required quantity of the particle media to be discharged, prevent generation of short pass and chocking phenomena, secure safety, obtain excellent crushing efficiency and dispersing efficiency and attain economical advantage. The dispersing apparatus has a structure having first and second rotational shafts (5A, 5B) disposed in a vessel (3) having ports for supplying and discharging a material to be dispersed, to run parallel to each other and rotatively, a plurality of stirring blades (7A, 7B) provided in an axial direction and apart from one another at arbitrary intervals for the first and second rotational shafts and located alternately in the axial direction, and particle media arranged to perform a process for dispersing the material and enclosed in the vessel (3), wherein portions of rotational regions of the stirring blades (7A, 7B) provided for the first and second rotational shafts overlap, and the vessel (3) has an inner surface formed by combining two circular arc curved surfaces (9A, 9B) formed along the outer rotational ends of the stirring blades (7A, 7B) provided for the first and second rotational shafts.

30 Claims, 9 Drawing Sheets

DISPERSING APPARATUS

TECHNICAL FIELD

The present invention relates to a dispersing apparatus for performing a process for dispersing a material, which is a raw material of a mill base, in which, for example, powder pigment is dispersed in a varnish or a solvent at a high concentration, and more particularly to a dispersing apparatus in which the distance for which the material to be dispersed is moved in a vessel thereof is elongated so as to sufficiently disperse the material.

BACKGROUND ART

For example, ink for printing and a coating material have been manufactured by using a mill base in which powder pigment is dispersed in a varnish or a solvent at a high concentration. It is preferable that a process in which powder pigment is dispersed in a solvent or the like be performed such that powder pigment of secondary particles in a state where primary particles of the pigment have been aggregated are crushed and dispersed in a solvent to form fine pigment particles in which coarse particles do not exist in order to improve the coloring power of the ink for printing or the coating material.

Hitherto, as the dispersing apparatus, a sand mill, a grain mill, a ball mill, an attritor and the like have been known. Among the dispersing apparatuses above, a structure for continuously performing the dispersing process and arranged as shown in FIG. 7 has been known.

That is, the structure is a horizontal structure having a cylindrical vessel 101 disposed horizontally. In the vessel 101, a rotational shaft 103 is horizontally and rotatively disposed. A plurality of pin type stirring blades 105 projecting in the radial directions are provided for the rotational shaft 103 to be disposed apart from one another at arbitrary intervals in the axial direction. In the vessel 101, spherical particle media 107 made of, for example, steel, ceramics or stones, are enclosed in order to perform the process for dispersing the material.

With the foregoing structure, when the rotational shaft 103 is rotated by a motor or the like and a raw material for a mill base is supplied through a supply port 109 formed at an end of the vessel 101, the particle media 107 are stirred by the plurality of stirring blades 105 provided for the rotational shaft 103. Therefore, the process for dispersing the raw material for the mill base can be performed. The mill base, subjected to the dispersing process, is continuously discharged through a discharge port 111 formed at another end of the vessel 101.

The foregoing structure sometimes encounters a so-called short pass in which the raw material for the mill base supplied into the vessel 101 through the supply port 109 cannot uniformly be dispersed and therefore the mill base containing coarse pigment particles is discharged through the discharge port 111. Therefore, there arises a problem in that the dispersing process cannot satisfactorily be performed.

When the movement of the particle media 107 is observed, the particle media 107 are in a tendency to follow the rotation of the stirring blades 105 provided for the rotational shaft 103 and rotate together with the same. Therefore, there arises a problem in that the dispersing process cannot effectively be performed.

If the rate of charging the particle media 107 into the vessel 101 is raised in order to prevent the short pass, the short pass can somewhat be prevented. If the rate of charging the particle media 107 Is raised excessively, a choking phenomenon takes place in which the particle media 107 are, in the J101, moved eccentrically toward the discharge port 111. Thus, another problem arises in that the operation cannot be performed safely. Accordingly, the rate of charging of the particle media is generally determined to be 75 to 80% at the time of performing the operation.

A conventional structure shown in FIG. 8 can be available. The structure is a vertical structure in which a cylindrical vessel 101 is disposed vertically. A rotational shaft 103 having stirring blades 105 is vertically and rotatively disposed.

The foregoing structure is formed by converting the horizontal structure into a vertical structure in which the raw material for the mill base is supplied into the vessel 101 through a supply port 109 opened and formed in the upper portion of the vessel 101. Moreover, the rotational shaft 103 is rotated to stir the particle media 107 so that the process for dispersing the raw material for the mill base is performed. The mill base subjected to the dispersing process is discharged through the discharge port 111 formed in the lower portion of the vessel 101. The discharge port 111 has a particle-media separation mechanism 113 in the form of, for example, a lattice or a net and arranged to prevent discharge of the particle media 107 and a raw-material discharge valve 115 capable of opening/closing the discharge port 111.

Since the foregoing structure is formed by simply converting the vessel 101 from the horizontal structure into the vertical structure, a problem similar to that suffered with the horizontal structure arises.

Another conventional structure is arranged as shown in FIGS. 9 and 10. Schematically, the foregoing structure is arranged such that first and second rotational shafts 117A and 117B are vertically disposed in a vertical and cylindrical vessel 101. Plate-like first and second stirring blades 119A and 119B having phases shifted from each other by 90° are provided for the first and second rotational shafts 117A and 117B so as to perform rotation while preventing interference of the first and second stirring blades 119A and 119B.

With the foregoing structure, portions of the loci of rotations of the first and second stirring blades 119A and 119B overlap. However, since each of the first and second stirring blades 119A and 119B has a plate-like shape, a portion of the raw material for the mill base is rotated together in the vessel 101. Moreover, portions adjacent to regions 121A and 121B are outside the rotational regions for the first and second stirring blades 119A and 119B. Thus, there arises a problem in that the process for dispersing the raw material for the mill base cannot satisfactorily be performed and the same is made to be non-uniform.

As prior arts considered to be related to the present invention, there are inventions disclosed in Japanese Patent Laid-Open No. 1-224057 (Prior Art 1), U.S. Pat. No. 4,673,134 (Prior Art 2), U.S. Pat. No. 3,199,792 (Prior Art 3), U.S. Pat No. 4,919,347 (Prior Art 4), and U.S. Pat. No. 4,998,678 (Prior Art 5).

The Prior Art 1 has a structure such that first and second rotational shafts are vertically and rotatively disposed in a vessel having an oblong cross sectional shape; and portions of rotation loci of the first and second stirring blades provided for the first and second rotational shafts overlap. However, dead spaces each having a substantially a triangular shape surrounded by the inner surface of the vessel and the rotational loci are formed in front and rear of the portion in which the loci of rotations of the first and second stirring blades overlap and on the two sides of the same when viewed in the rotational direction of the first and second stirring blades. The raw material for the mill base located in the dead spaces cannot satisfactorily be dispersed and the same can easily be made non-uniform.

The Prior Art 2 has disclosed a structure such that stirring blades are provided for a plurality of rotational shafts. Also the structure of the Prior Art 2 encounters the generation of the substantially triangular dead space between the rotation loci of the stirring blades and the inner surface of the vessel. Thus, a problem similar to that experience with the Prior Art 1 arises.

FIG. 8 of Prior Art 3 discloses a structure in which first and second rotational shafts are vertically and rotatively disposed in a vessel having a shape formed by combining two circular arc curved planes; and stirring blades extending in three directions are provided for the first and second rotational shafts. Each of the three stirring blades has a plate-like shape and arranged to be orated in opposite directions. Moreover, their rotation loci are in contact with each other. Although the problem of the dead space can therefore be overcome, the particle media and the like are in a tendency of easily rotating together with the stirring blades. Thus, there arises a problem in that the raw material for the mill base cannot satisfactorily be dispersed.

The Prior Art 4 has disclosed a structure in which cylindrical first and second rotors each having a multiplicity of projections and pits on the outer surfaces thereof are disposed in a vessel having a shape formed by combining two circular arc curved planes. The foregoing structure has a problem in that the outer surface of the first rotor is not engaged with the outer surface of the second rotor, therefore the rotation loci of the rotors do not overlap, and that the process for manufacturing the rotor becomes too complicated.

The Prior Art 5 has disclosed a structure such that a rotational shaft is vertically and rotatively disposed at an eccentric position in a rotative, vertical and cylindrical vessel. Moreover, a plurality of discs having a plurality of holes in the vicinity of the outer ends thereof are provided for the rotational shaft. Since the foregoing structure is arranged such that the vessel is rotated and the rotational shaft disposed at an eccentric position in the vessel is rotated, there arises a problem in that the overall structure becomes too complicated.

DISCLOSURE OF INVENTION

The present invention has been established in view of the above-mentioned problems. According to the invention, there is provided a dispersing apparatus comprising first and second rotational shafts disposed, in a vessel having ports for supplying and discharging a material to be dispersed, to run parallel to each other and rotatively, a plurality of stirring blades provided, in an axial direction and apart from one another at arbitrary intervals, for the first and second rotational shafts and located alternately in the axial direction, and particle media arranged to perform a process for dispersing the material and enclosed in the vessel, wherein portions of rotational regions of the stirring blades provided for the first and second rotational shafts overlap, and the vessel has an inner surface formed by combining two circular arc curved surfaces formed along the outer rotational ends of the stirring blades provided for the first and second rotational shafts.

As a result of the above-mentioned structure, when the first and second rotational shafts are rotated and the material to be dispersed are supplied through the supply portion of the vessel, the particle media are, in the vessel, stirred by the stirring blades so that the material to be dispersed is subjected to the dispersing process. Since the inner surface of the vessel is formed by combining two circular arc curved plane formed along the rotational end of the stirring blades provided for the first and second rotational shafts and portions of the rotational regions of the stirring blades overlap, dead space in which the particle media cannot satisfactorily be stirred is not formed in the vessel. Moreover, since the rotational direction of the first and second rotational shafts are made to be the same, the directions in which the stirring blades are moved in opposite directions in the region in which the rotational regions of the stirring blades overlap. Therefore, mutual collision of the particle media causing the same to be rotate together can be prevented. In case the rotational direction of the first and second rotational shafts made to be opposite, mutual collision of the particle media causing the same to be rotate together can be disturbed in the region in which the rotational regions of the stirring blades overlap. Therefore, the rotational direction of the first and second rotational shafts are not limited to the same, it is preferable that they are the same.

Therefore, the material to be dispersed can satisfactorily be dispersed in the region in which the rotational regions overlap. Therefore, pigment particles in the solvent can furthermore be fined and difference in the concentration can be eliminated and the pigment particles can be made to be uniform.

The invention has a structure such that the first and second rotational shafts are disposed horizontally, and a plane including the axes of the first and second rotational shafts is a vertical plane. Therefore, the structure is formed such that the first and second rotational shafts are disposed vertically. Thus, the load of the particle media in the chamber in which the upper rotational shaft is disposed acts on the particle media in the chamber in which the lower rotational shaft is disposed. Moreover, the lower chamber is brought to a state where it is filled with the particle media. Therefore, the dispersing process can furthermore effectively be performed.

The invention has a structure such that the first and second rotational shafts are disposed horizontally, and a plane including the axes of the first and second rotational shafts is a horizontal plane. Therefore, the first and second rotational shafts are disposed adjacently in a horizontal direction. As a result, the quantities of the particle media in the chambers in which the first and second rotational shafts are disposed are made to be substantially the same and the material to be dispersed can easily be allowed to meander in each chamber. Thus, the distance for which the material to be dispersed is moved from the supply port to the discharge port can be lengthened and the dispersing process can sufficiently be performed.

The invention has a structure such that the first and second rotational shafts are disposed horizontally, and a plane including the axes of the first and second rotational shafts can be changed between a vertical state and a horizontal state. Therefore, the positional relationship between the first and second rotational shafts can be varied in the vertical state and the horizontal state. As a result, the characteristics of both of the states are used to effectively perform the dispersing process.

The invention has a structure such that the first and second rotational shafts are disposed vertically and a plane including the axes of the first and second rotational shafts is a vertical plane. Therefore, the chambers in which the first and second rotational shafts are disposed are vertically disposed so that the quantities of the particle media in the chambers in which the first and second rotational shafts are disposed are made to be substantially the same and the material to be dispersed are easily be allowed to meander in each chamber. As a result, an effect similar to that obtainable from the invention.

The invention has a structure such that at least one plate-like blade is provided for at least either of the first and second rotational shafts. Therefore, the plate-like blade realizes a tendency of preventing movement of the material to be dispersed along the shaft so that meandering of the material to be dispersed is enhanced. As a result, meandering can be performed effectively and the distance for which the material to be dispersed is moved can be lengthened. As a result, the dispersing process can effectively be performed.

The invention has a structure such that assuming that radii of the first and second rotational shafts are rA and rB, rotational radii of each of the stirring blades provided for the first and second rotational shafts are RA and RB, and distance between axes of the first and second rotational shafts is L, a relationship $rB+RA=rA+RB<L\leqq 0.9\,(RA+RB)$ is satisfied. Therefore, portions of the rotational regions of the stirring blades provided for the first and second rotational shafts always overlap. Thus, rotations of the particle media together with the stirring blades can be prevented in the overlap portion.

The invention has a structure such that the distance from the outer surface of each of the first and second rotational shafts and the rotational outer ends of the stirring blades provided for the first and second rotational shafts and the distance from the rotational outer ends of the stirring blades and the inner surface of the vessel are not less than three times the mean diameter of the particle media nor more than about 10 times. Therefore, clogging of the particle media in the gaps between the first and second rotational shafts and stirring blades and between the stirring blades and the inner surface of the vessel can be prevented. Moreover, deterioration in the dispersing process attributable to the excessively large gap can be prevented.

The invention has a structure such that the rotational directions of the first and second rotational shafts are the same. Therefore, the direction in which the stirring blades are moved are made to be opposite in the position at which the rotational regions of the stirring blades overlap. As a result, rotations of the particle media together with the rotational shafts can effectively be prevented.

BEST MODE FOR CARRYING OUT THE INVENTION

Preferred embodiments of the present invention will now be described with reference to the drawings.

Figure 1:
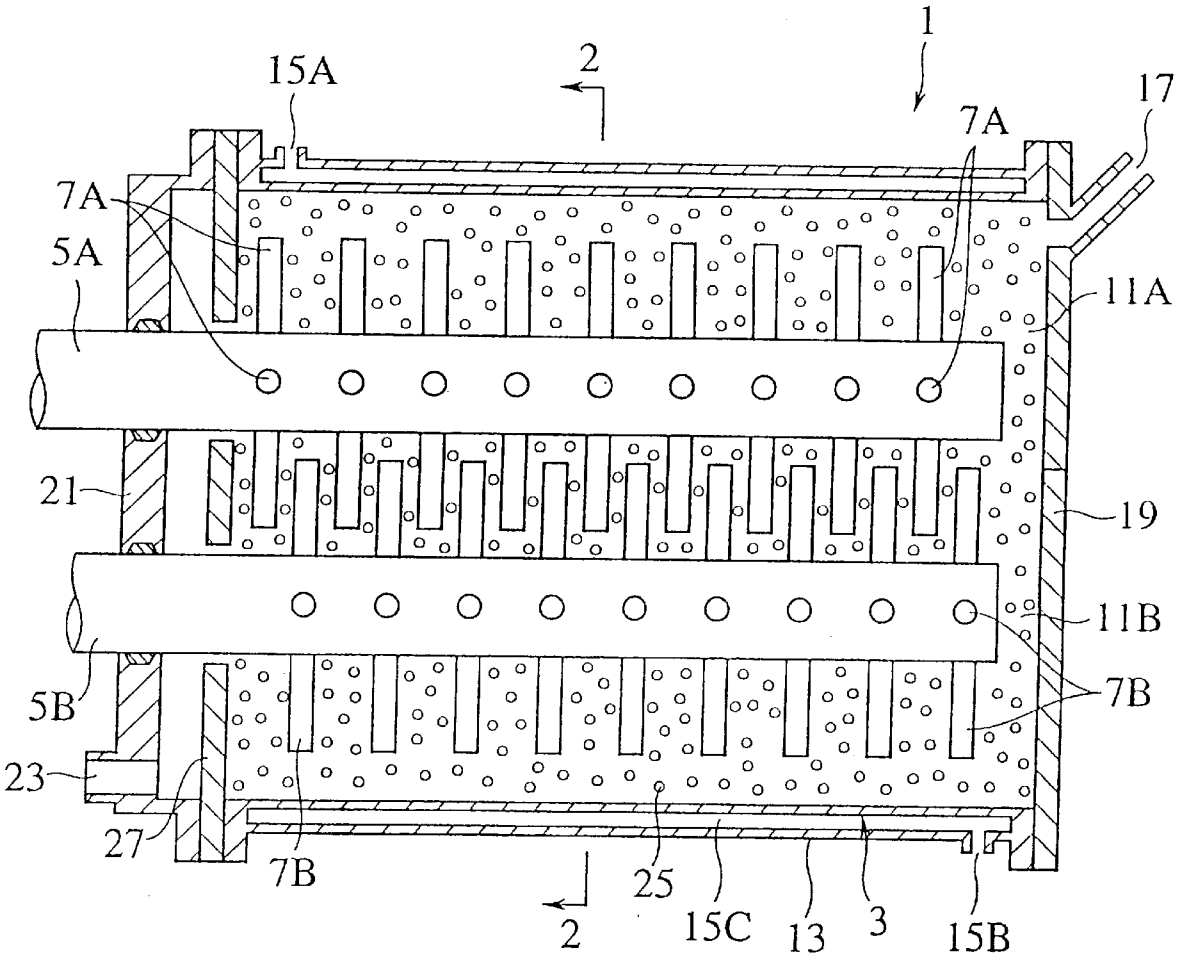
FIG. 1 is a cross sectional view of explanation schematically showing a dispersing apparatus according to a first embodiment of the present invention.
Figure 2:
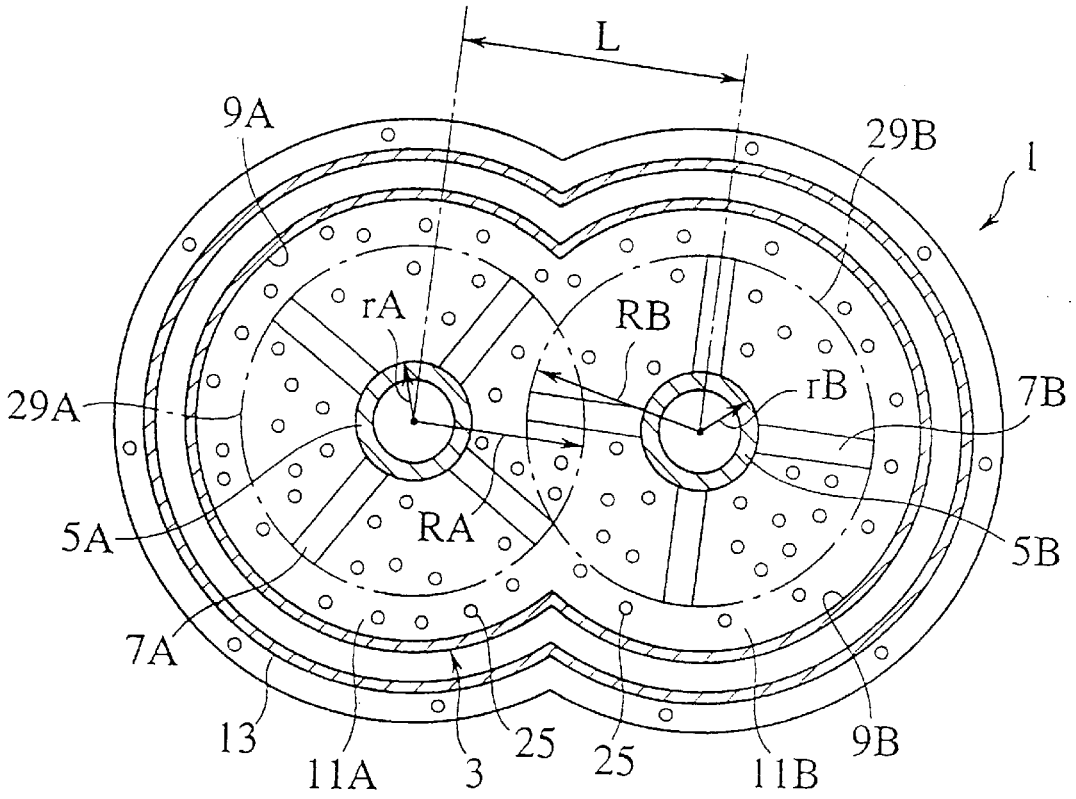
FIG. 2 is a cross sectional view of explanation taken along line 2—2 shown in FIG. 1.

Referring to FIGS. 1 and 2, a dispersing apparatus 1 according to a first embodiment has a cylindrical vessel 3 having a horizontal axis. The vessel 3 includes first and second rotational shafts 5A and 5B running in parallel to each other and disposed horizontally and rotatively. The first and second rotational shafts 5A and 5B have a plurality of pin-shape stirring blades 7A and 7B projecting and elongating in a radial direction and disposed at arbitrary intervals in the axial direction.

More specifically, the inner surface of the foregoing vessel 3, as shown in FIG. 2, is formed into a shape realized by joining circular-arc curved surfaces 9A and 9B formed along the outer surfaces of the rotating stirring blades 7A and 7B provided for the first and second rotational shafts 5A and 5B. That is, the cross sectional shape in which the first and second rotational shafts 5A and 5B are disposed is formed into a shape realized by joining first and second chambers 11A and 11B each having a substantially ¾ circular arc shape, the shape being in a supercilium shape.

The vessel 3 has an outer wall 13 on the outside of an inner wall having the circular-arc curved surfaces 9A and 9B. A cooling chamber 15C communicated with an inlet port 15A and an outlet port 15B for a cooling medium is formed between the inner wall and the outer wall 13. A first cover member 19, having a supply port 17 for a raw material for the mill base in which, for example, powder pigment has been dispersed in a varnish or a solvent at a high concentration, is detachably secured to an end of the vessel 3 by arbitrary fixing members (not shown), such as bolts.

At another end of the vessel 3, there is, by arbitrary fixing members, detachably attached a second cover member 21 horizontally and rotatively supporting the first and second rotational shafts 5A and 5B. The second cover member 21 has a discharge port 23. Between the second cover member 21 and the vessel 3, there is disposed a net or a lattice shape particle-media separation mechanism 27 in order to disperse a particle media 25 filled in the vessel 3 and the material to be dispersed (the mill base) subjected to the dispersing process.

The particle media 25 is, for example, spherical, flat or amorphous steel, ceramics, crystal or the like. In the case where the spherical media is employed, a media having a mean particle size of 0.2 mm to 15 mm is employed. The charging rate of the particle media 25 in the vessel 3 is 70 to 95%.

Although the first and second rotational shafts 5A and 5B have cooling medium passage through which the cooling medium can be circulated, the cooling medium passage are not always necessary. Each of the stirring blades 7A and 7B provided for the first and second rotational shafts 5A and 5B according to this embodiment is in the form of a projecting cruciform consisting of four pins disposed in the radial direction. The number of the pins is not limited to four but the number may be an arbitrary number. The cross sectional shape of each pin is not limited to the circular shape but it may be another arbitrary shape.

The stirring blades 7A and 7B provided for the first and second rotational shafts 5A and 5B are, as shown in FIG. 1, are alternately disposed in the axial direction of each of the first and second rotational shafts 5A and 5B. Moreover, rotation regions 29A and 29B of the stirring blades 7A and 7B are, as shown in FIG. 2, structured such that their portions overlap.

The first and second rotational shafts 5A and 5B are arranged to be rotated at the same speed in the same direction by a motor (not shown). At this time, it is preferable that the circumferential speed of each of the stirring blades 7A and 7B be 6 m/s to 17 m/s and the two circumferential speeds are the same.

Assuming that the radii of the first and second rotational shafts 5A and 5B of the above-mentioned structure respectively are rA and rB, the rotational radii of the stirring blades 7A and 7B respectively are RA and RB, and the distance between the first and second rotational shafts 5A and 5B is L, a relationship $rB+RA=rA+RB<L\leqq 0.9\ (RA+RB)$ is held. The distance from the surface of each of the first and second rotational shafts 5A and 5B and the outer surface of each of the stirring blades 7B and 7A at the time of the rotation and the distance from the outer surface of each of the stirring blades 7A and 7B at the time of the rotation and the inner surface of the vessel 3 is not less than three times the mean diameter of the particle media 25 nor more than about 10 times of the same.

Therefore, the particle media 25 cannot be interposed between the stirring blades 7A and 7B and the first and second rotational shafts 5A and 5B and the inner surfaces 9A and 9B of the first and second chambers 11A and 11B. Moreover, a problem of a type which arises in that the stirring efficiency and the like deteriorate attributable to an excessively long distance between the stirring blades 7A and 7B and the inner surfaces 9A and 9B can be prevented.

In the structure above, when the first and second rotational shafts 5A and 5B are rotated in the same directions and the raw material for the mill base (material to be dispersed) is supplied into the vessel 3 from the supply port 17, the particle media 25 in the vessel 3 are moved and stirred by the plural stirring blades 7A and 7B provided for the first and second rotational shafts 5A and 5B. Thus, the material to be dispersed is brought to a state where it is mixed with the particle media 25 and stirred so that the dispersing process is performed.

At this time, the material to be dispersed alternately meanders in the first and second chambers 11A and 11B in which the first and second rotational shafts 5A and 5B are disposed attributable to rotations of the stirring blades 7A and 7B. Therefore, the distance of the movement is lengthened. As a result of the rotations of the stirring blades 7A and 7B, the particle media 25 in the vessel 3 are in a trend of following the rotations of the stirring blades 7A and 7B and therefore rotating together with the same. In the portion in which the rotation regions 29A and 29B of the stirring blades 7A and 7B overlap, the particle media 25 collide with one another because the directions of the movement of the stirring blades 7A and 7B are opposite to each other. As a result, the collective rotation can effectively be prevented. Moreover, the collision enables stirring to be performed effectively. As a result, the material to be dispersed can be dispersed more effectively in the overlap portion.

The material to be dispersed, which has been subjected to the dispersing process, is separated from the particle media 25 by a particle-media separation mechanism 27, and then discharged to the outside through the discharge port 23.

As can be understood from the description above, the material to be dispersed alternately meanders in the first and second chambers 11A and 11B, thus causing the distance of movement to be lengthened. Moreover, a phenomenon that the material to be dispersed collides with the particle media 25 in the region in which the rotational regions of the stirring blades 7A and 7B overlap. As a result, stirring can effectively be performed, thus enabling the amount of the particle media 25, which must charged, to be reduced.

In order to confirm the effect of the dispersing apparatus having the foregoing structure, a comparison test was performed.

EXAMPLES

Example 1 to 7 and Comparative Examples 1 to 7

Figure 7:
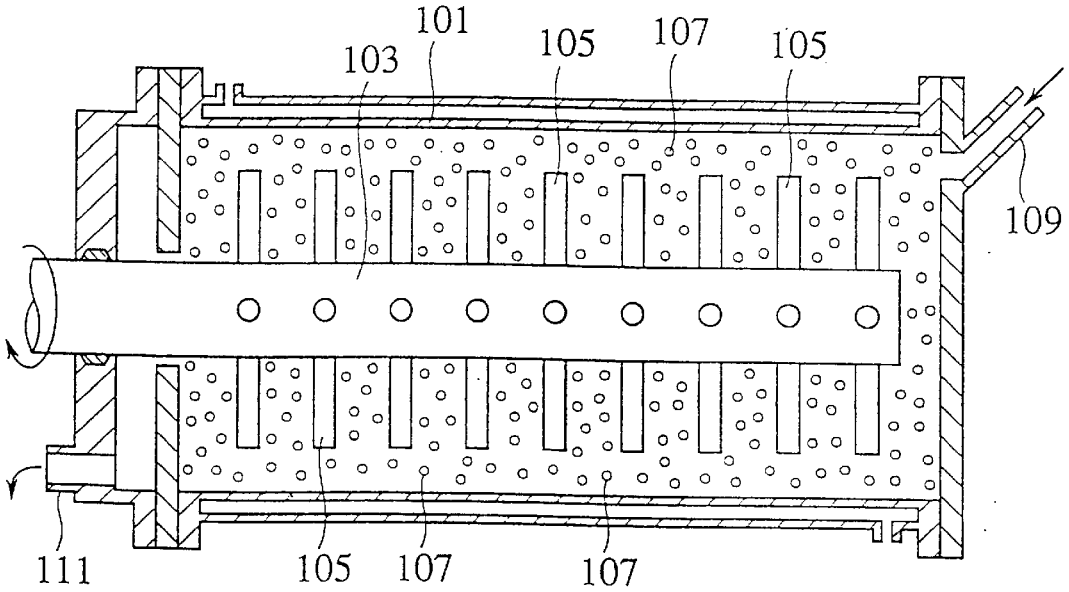
PRIOR ART FIG.7
FIG. 7 is a cross sectional view of explanation schematically showing a dispersing apparatus according to a first example of a conventional apparatus.

Pigment (12 parts by weight), alkyd resin (38 parts by weight) and xylene (40 parts by weight) were mixed with the foregoing ratio, and then the mixed material was dispersed in a dispersing apparatus having the structure as shown in FIGS. 1 and 2 and according to the present invention. As a result, a pigment dispersed base was prepared. Melamine resin (12 parts by weight) was mixed with the pigment dispersed base (88 parts by weight) so that an alkyd/melamine coating material was prepared. As comparative examples, coating materials were employed which were obtained by, for the same time, dispersing raw materials respectively having the same compositions as those of the materials according to examples by using a conventional uniaxial sand mill structured as shown in FIG. 7. The particle size distribution was measured, thus resulting in the pigments obtained by using the dispersing apparatus according to the present invention had smaller particle sizes as compared with the pigments obtained by the dispersing apparatus according to the comparative examples as shown in Table 1. As a result, excellent dispersing characteristic was exhibited.

The foregoing coating material was diluted by a base coating material of titanium oxide (which was paste, in which titanium oxide was dispersed and which was obtained by dispersing titanium oxide in an alkyd/melamine system with 50 PHR) in such a manner that the ratio of the pigment and titanium oxide was 1/10 so that light-color coating material was prepared. The light color coating material was applied to art paper by a 6 mm applicator, and then allowed to stand for 10 minutes. Then, the coloring power of each coated film baked at 140° C. for 30 minutes was measured. The color power coloring power was obtained in accordance with color difference value DL measured such that the comparative example was employed as a reference such that the color power was expressed by $(100-DL\times 10)$ assuming that the coloring power of the comparative example was made to be 100. As shown in Table 1, the coated films formed by using the dispersing apparatus according to the present invention exhibited stronger coloring power than that formed by using the dispersing apparatus according to the comparative examples.

The viscosity of each coating materials was adjusted such that 20 seconds are realized in a #4 Ford cup, and then the coating material was applied to an intercoated plate (a steel plate previously applied with a primer coating material and then wet-rubbed) to have a dry film thickness of about 30 mm by using an air spray and then allowed to stand for 10 minutes. Then, the coated film was baked at 140° C. for 30 minutes. The luster of the coated plate was measured, thus resulting in that the coated plate formed by using the dispersing apparatus according to the present invention exhibited excellent luster of the coated film as compared-with the luster of the coated plate formed by using the dispersing apparatus according to the comparative example, as shown in Table 1.

TABLE 1

| Examples | Pigment | article Size Distribution D50 (μm) | Coloring Power | Luster (%) 20° G | Luster (%) 60° G |
|---|---|---|---|---|---|
| Comparative Example 1 | C.I.Pigment Red 177 | 0.20 | 100 | 45.8 | 75.5 |
| Example 1 | (Anthraquinoe Pigment) | 0.12 | 110 | 77.9 | 85.4 |
| Comparative Example 2 | C.I.Pigment Violet 19 | 0.32 | 100 | 55.4 | 78.8 |
| Example 2 | (Quinacridon Pigment) | 0.22 | 115 | 80.6 | 88.4 |
| Comparative Example 3 | C.I.Pigment Red 178 | 0.27 | 100 | 60.9 | 79.5 |
| Example 3 | (Perylene Pigment) | 0.19 | 112 | 82.0 | 89.8 |
| Comparative Example 4 | C.I.Pigment Blue 15:1 | 0.31 | 100 | 61.4 | 80.3 |
| Example 4 | (Pthalocyanine Pigment) | 0.24 | 118 | 83.5 | 91.5 |
| Comparative Example 5 | C.I.Pigment Violet 23 | 0.25 | 100 | 60.5 | 79.1 |
| Example 5 | (Dioxazine Pigment) | 0.18 | 108 | 81.1 | 88.0 |
| Comparative Example 6 | C.I.Pigment Red 254 | 0.36 | 100 | 54.0 | 76.5 |
| Example 6 | (Diketopyroropyrrole Pigment) | 0.25 | 112 | 79.5 | 85.9 |
| Comparative Example 7 | C.I.Pigment Red 101 | 0.20 | 100 | 70.3 | 85.2 |
| Example 7 | (Inorganic Pigment) | 0.11 | 110 | 80.7 | 93.0 |

Luster: luster level at changed angles of 20° and 60°

In a case where a comparison was made by using dispersing apparatus having the same capacities, the performance for manufacturing the printing ink mill base was improved by about 50%.

Figure 3:
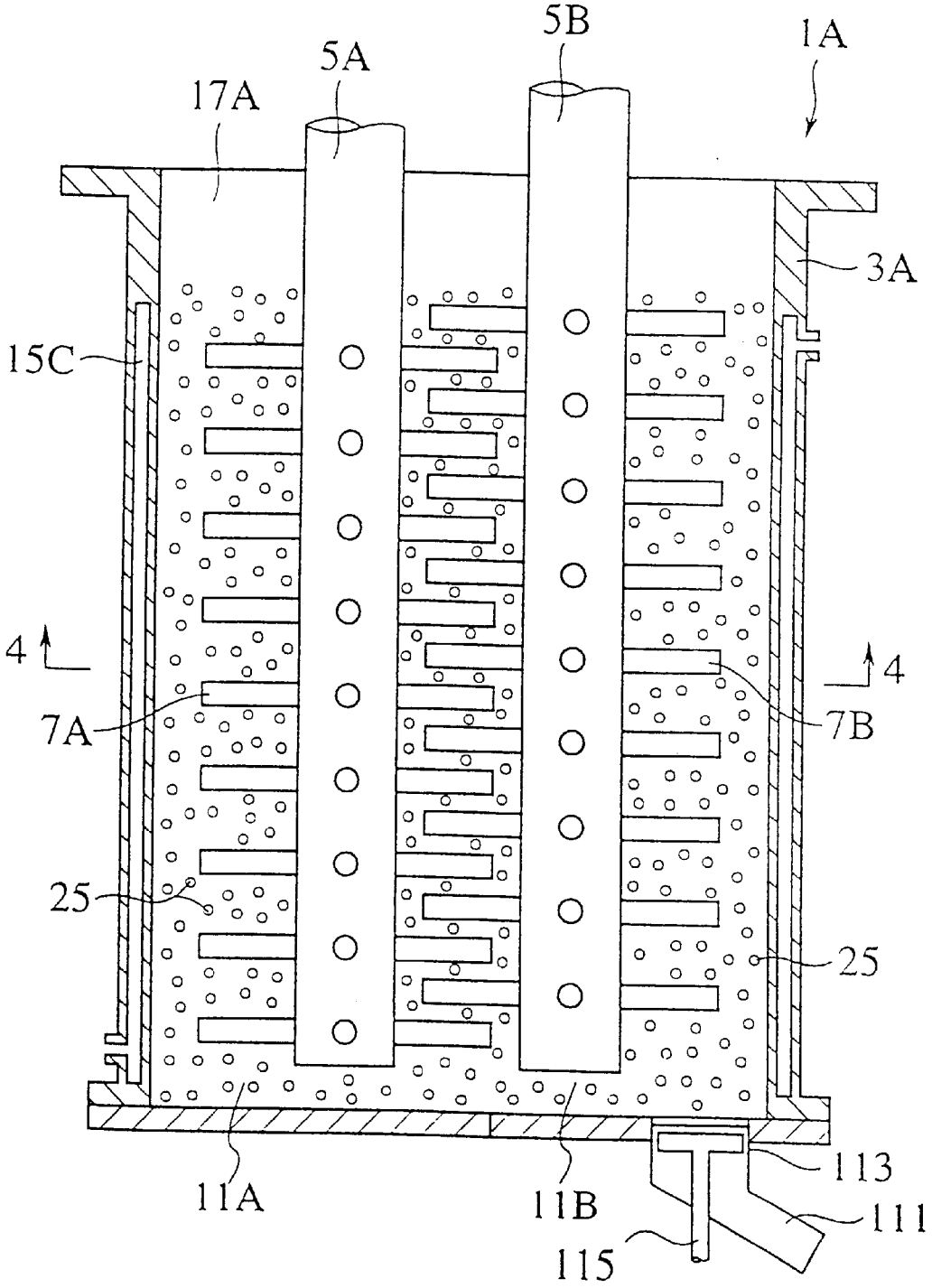
FIG. 3 is a cross sectional view of explanation showing a dispersing apparatus according to a second embodiment of the present invention.
Figure 4:
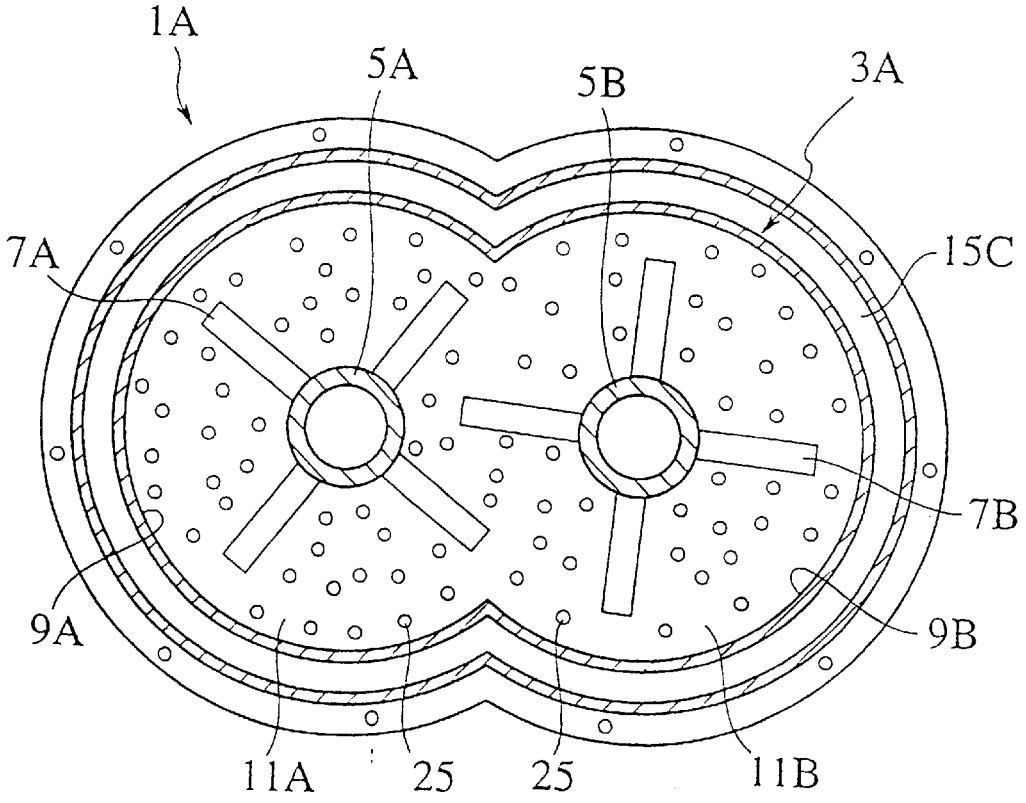
FIG. 4 is a cross sectional view of explanation taken along line 4—4 shown in FIG. 3.

FIGS. 3 and 4 show a dispersing apparatus 1A according to a second embodiment. The dispersing apparatus 1A has a vessel 3A having the same cross sectional shape as that of the vessel 3 according to the first embodiment and disposed vertically. A supply port 17A is formed in the upper portion of the vessel 3A. Moreover, a discharge port 111, a particle-media separation mechanism 113 and a valve 115 respectively having the structures similar to those of the conventional structure are disposed in the bottom portion. Since the other structures are substantially the same as those according to the first embodiment, elements having the same functions are given the same reference numerals and the similar portions are omitted from illustration.

In the second embodiment, the axis of the vessel 3 and the first and second rotational shafts 5A and 5B are perpendicular to each other. Moreover, a plane including the axis of the first and second rotational shafts 5A and 5B is made vertical. Therefore, the first and second chambers 11A and 11B in which the first and second rotational shafts 5A and 5B are located are formed adjacently in the horizontal direction. As a result, the quantity of the particle media in the first and second chambers 11A and 11B are substantially the same. The material to be dispersed, which has been supplied into the vessel 3A through the supply port 17A, meanders in each of the first and second chambers 11A and 11B to reach the discharge port 111. As a result, a similar effect to that obtainable from the first embodiment can be obtained.

In order to confirm the effects of the dispersing apparatus according to the second embodiment, a comparison test was performed.

EXAMPLES

Examples 1 to 7 and Comparative Examples 1 to 7

Figure 8:
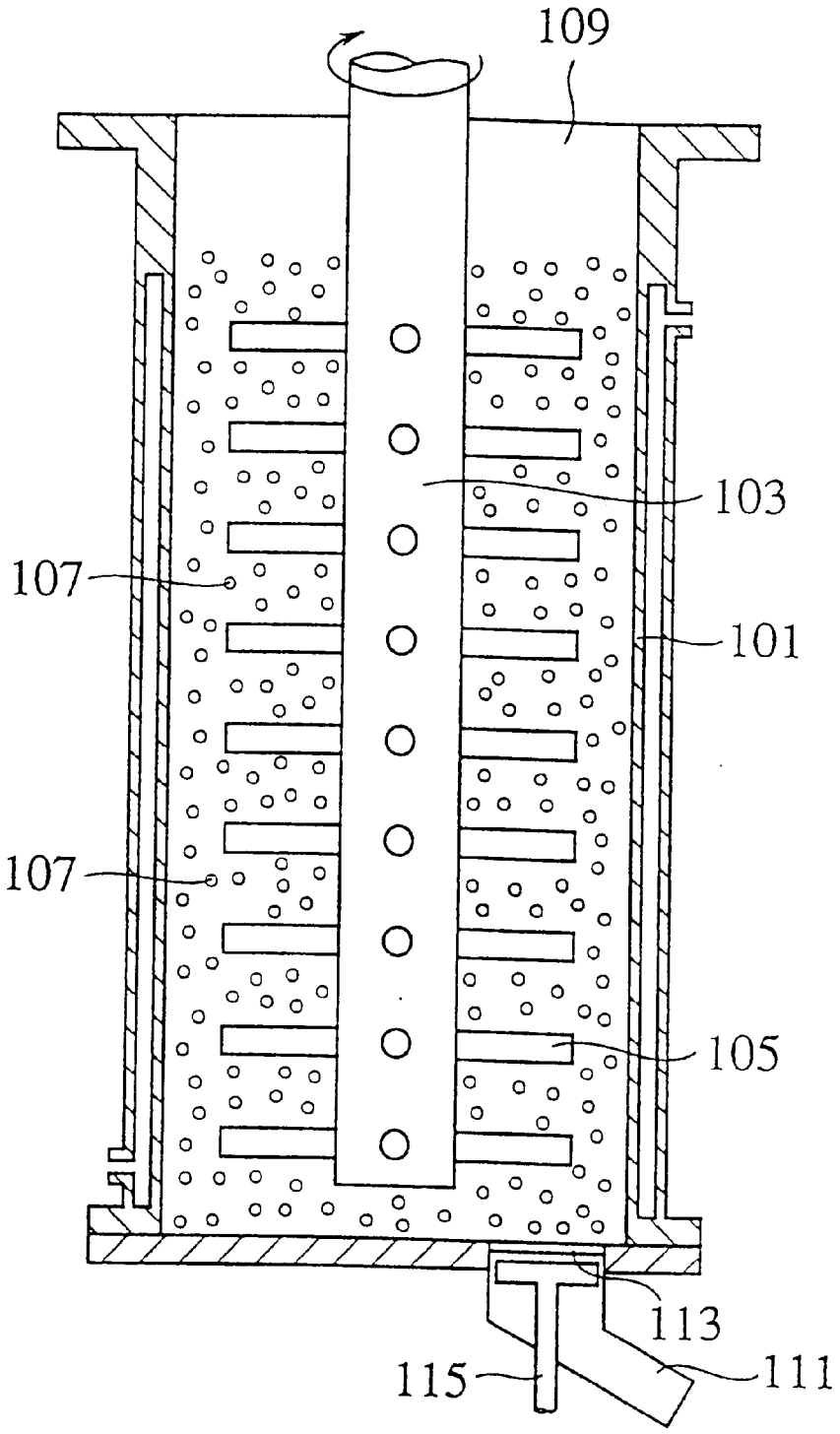
PRIOR ART FIG.8
FIG. 8 is a cross sectional view of explanation schematically showing a dispersing apparatus according to a second example of the conventional apparatus.
Figure 9:
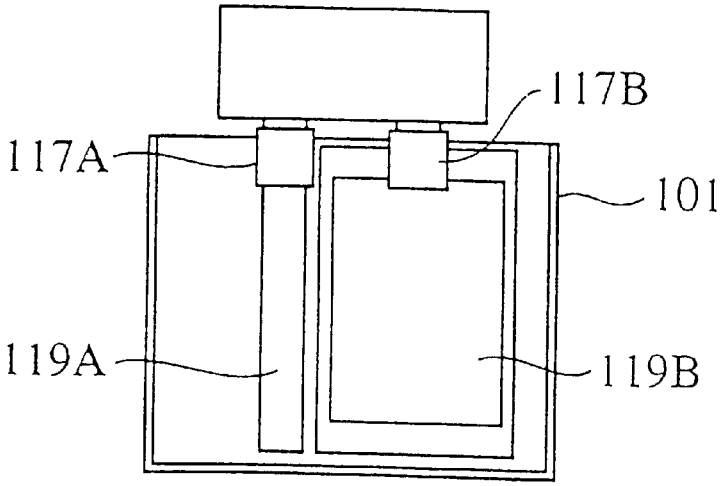
PRIOR ART FIG.9
FIG. 9 is a cross sectional view of explanation schematically showing a dispersing apparatus according to a third example of the conventional apparatus.
Figure 10:
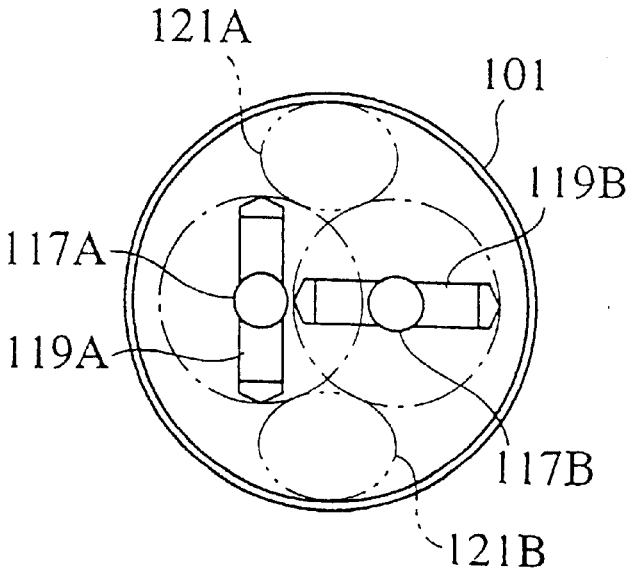
PRIOR ART FIG.10
FIG. 10 is a plain cross sectional view of FIG. 9.

Pigment (12 parts by weight), alkyd resin (38 parts by weight) and xylene (40 parts by weight) were mixed with the foregoing ratio, and then the mixed material was dispersed in a dispersing apparatus having the structure as shown in FIGS. 3 and 4 and according to the present invention. As a result, a pigment dispersed base was prepared. Melamine resin (12 parts by weight) was mixed with the pigment dispersed base (88 parts by weight) so that an alkyd/melamine coating material was prepared. As comparative examples, coating materials were employed which were obtained by, for the same time, dispersing raw materials respectively having the same compositions as those of the materials according to examples by using a conventional uniaxial sand mill structured as shown in FIG. 8. The particle size distribution was measured, thus resulting in the pigments obtained by using the dispersing apparatus according to the present invention had smaller particle sizes as compared with the pigments obtained by the dispersing apparatus according to the comparative examples as shown in Table 2. As a result, excellent dispersing characteristic was exhibited.

TABLE 2

| Examples | Pigment | article Size Distribution D50 (μ) | Coloring Power |
|---|---|---|---|
| Comparative Example 1 | C.I.Pigment Red 177 | 0.25 | 100 |
| Example 1 | (Anthraquinoe Pigment) | 0.20 | 107 |
| Comparative Example 2 | C.I.Pigment Violet 19 | 0.37 | 100 |
| Example 2 | (Quinacridon Pigment) | 0.27 | 112 |
| Comparative Example 3 | C.I.Pigment Red 176 | 0.31 | 100 |
| Example 3 | (Perylene Pigment) | 0.23 | 108 |
| Comparative Example 4 | C.I.Pigment Blue 15:1 | 0.36 | 100 |
| Example 4 | (Pthalocyanine Pigment) | 0.28 | 115 |
| Comparative Example 5 | C.I.Pigment Violet 23 | 0.30 | 100 |
| Example 5 | (Dioxazine Pigment) | 0.24 | 106 |
| Comparative Example 6 | C.I.Pigment Red 254 | 0.39 | 100 |
| Example 6 | (Diketopyroropyrrole Pigment) | 0.29 | 110 |
| Comparative Example 7 | C.I.Pigment Red 101 | 0.25 | 100 |
| Example 7 | (Inorganic Pigment) | 0.17 | 108 |

The foregoing coating material was diluted by a base coating material of titanium oxide (which was paste, in which titanium oxide was dispersed and which was obtained by dispersing titanium oxide in an alkyd/melamine system with 50 PHR) in such a manner that the ratio of the pigment and titanium oxide was 1/10 so that light-color coating material was prepared. The light color coating material was applied to art paper by a 6 mm applicator, and then allowed to stand for 10 minutes. Then, the coloring power of each coated film baked at 140° C. for 30 minutes was measured. The color power coloring power was obtained in accordance with color difference value DL measured such that the comparative example was employed as a reference such that the color power was expressed by (100−DL×10) assuming that the coloring power of the comparative example was made to be 100. As shown in Table 1, the coated films formed by using the dispersing apparatus according to the present invention exhibited stronger coloring power than that formed by using the dispersing apparatus according to the comparative examples.

In a case where a comparison was made by using dispersing apparatus having the same capacities, the performance for manufacturing the printing ink mill base was improved by about 50%.

The dispersing apparatus 1 shown in FIGS. 1 and 2 has the structure such that a plane including the axes of the first and second rotational shafts 5A and 5B is horizontal and the first and second chambers 11A and 11B in which the first and second rotational shafts 5A and 5B are located are disposed horizontally. Another structure may be employed in which the plane including the axes of the first and second rotational shafts 5A and 5B are made to be vertical. That is, the first and second chambers 11A and 11B in which the first and second rotational shafts 5A and 5B are located may be disposed vertically.

With the structure above, the lower chamber in the vessel is filled with the particle media and the weight of the particle media acts on the particle media in the lower chamber so that the dispersing process can be performed more efficiently in the lower chamber.

As can be understood from the foregoing description, the plane including the first and second rotational shafts 5A and 5B can be disposed horizontally or vertically. Therefore, employment of a structure in which the body of the vessel can be rotated around the horizontal axis thereof enables the plane including the axes of the first and second rotational shafts 5A and 5B to be changed between the horizontal state and the vertical state. The vertical relationship between the first and second chambers 11A and 11B in the vessel can be disposed conversely.

In the foregoing case, the positional relationship between the first and second chambers 11A and 11B in the vessel can be changed between horizontal and vertical positions. Therefore, the dispersing process can be performed by using the characteristics of both of the structures in which the first and second chambers 11A and 11B are formed horizontally and in which the same are formed vertically.

Figure 5:
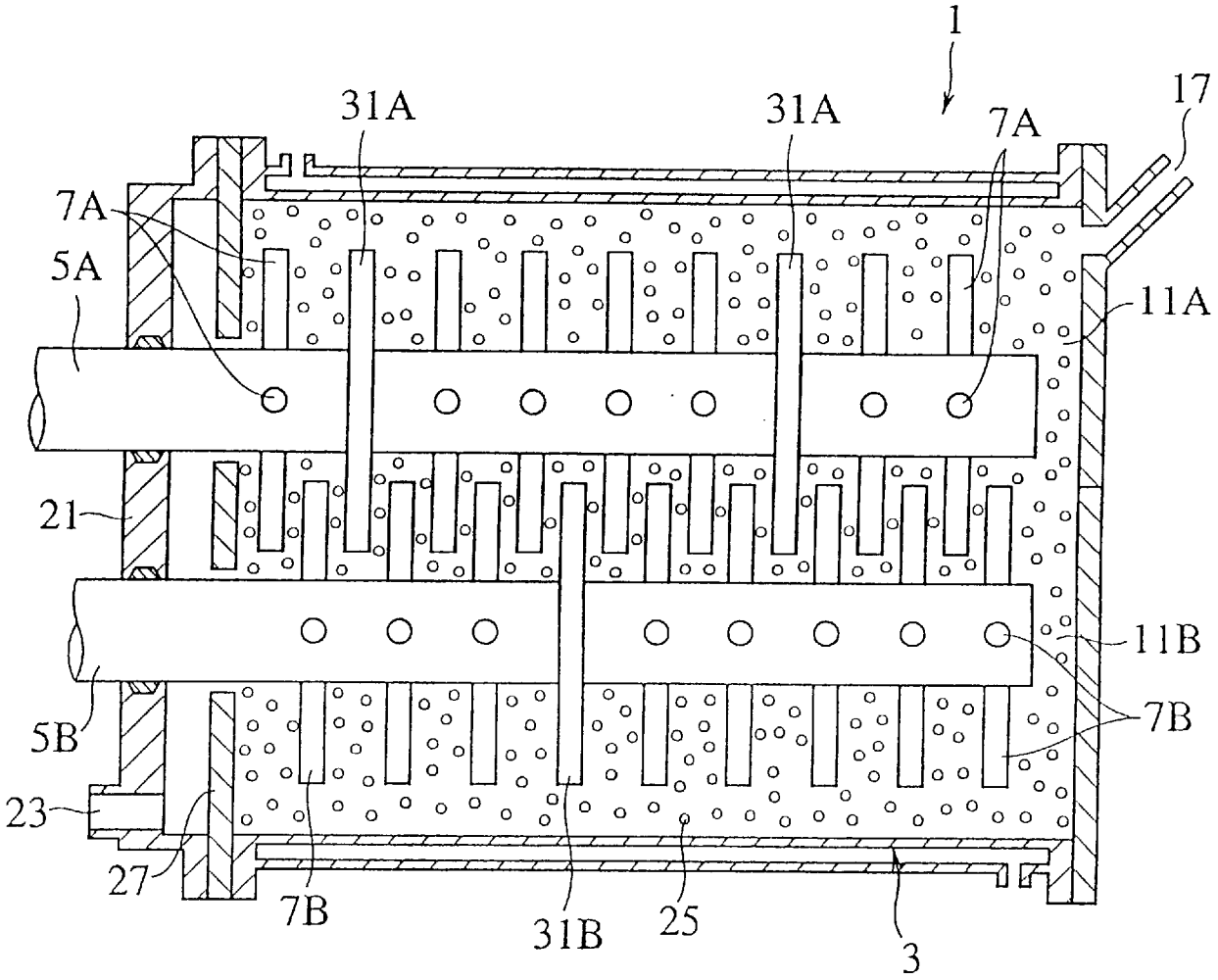
FIG. 5 is a cross sectional view of explanation schematically showing a dispersing apparatus according to a third embodiment of the present invention.

FIG. 5 shows a third embodiment. The third embodiment has substantially the same structure according to the first embodiment shown in FIGS. 1 and 2. The difference lies in that discs 31A and 31B disposed at an arbitrary distance respectively are provided for the first and second rotational shafts 5A and 5B so that short pass is prevented in which the material to be dispersed supplied into the vessel through the supply port 17 is moved in a direction along the first and second rotational shafts 5A and 5B. Moreover, the tendency in which the material to be dispersed meanders in the first and second chambers 11A and 11B can be enhanced. Since the other structures are the same as those according to the first embodiment, the components having the same functions are given the same reference numerals and the repeated description is omitted.

With the foregoing structure, the material to be dispersed supplied into the vessel 3 through the supply port 17 is reliably inhibited from being linearly movement toward the discharge port 23 by the discs 31A and 31B. Since the material to be dispersed reaches the discharge port 23 while meandering in the first and second chambers 11A and 11B, the distance for which the material to be dispersed is moved can be lengthened. Therefore, a further effective dispersing process can be performed.

As can be understood from the description above, the structure shown in FIG. 5 may be arranged such that the positional relationship between the first and second rotational shafts 5A and 5B has a vertical relationship. Also the structure shown in FIG. 3 may be formed such that the discs 31A and 31B are provided for the first and second rotational shafts 5A and 5B.

Figure 6:
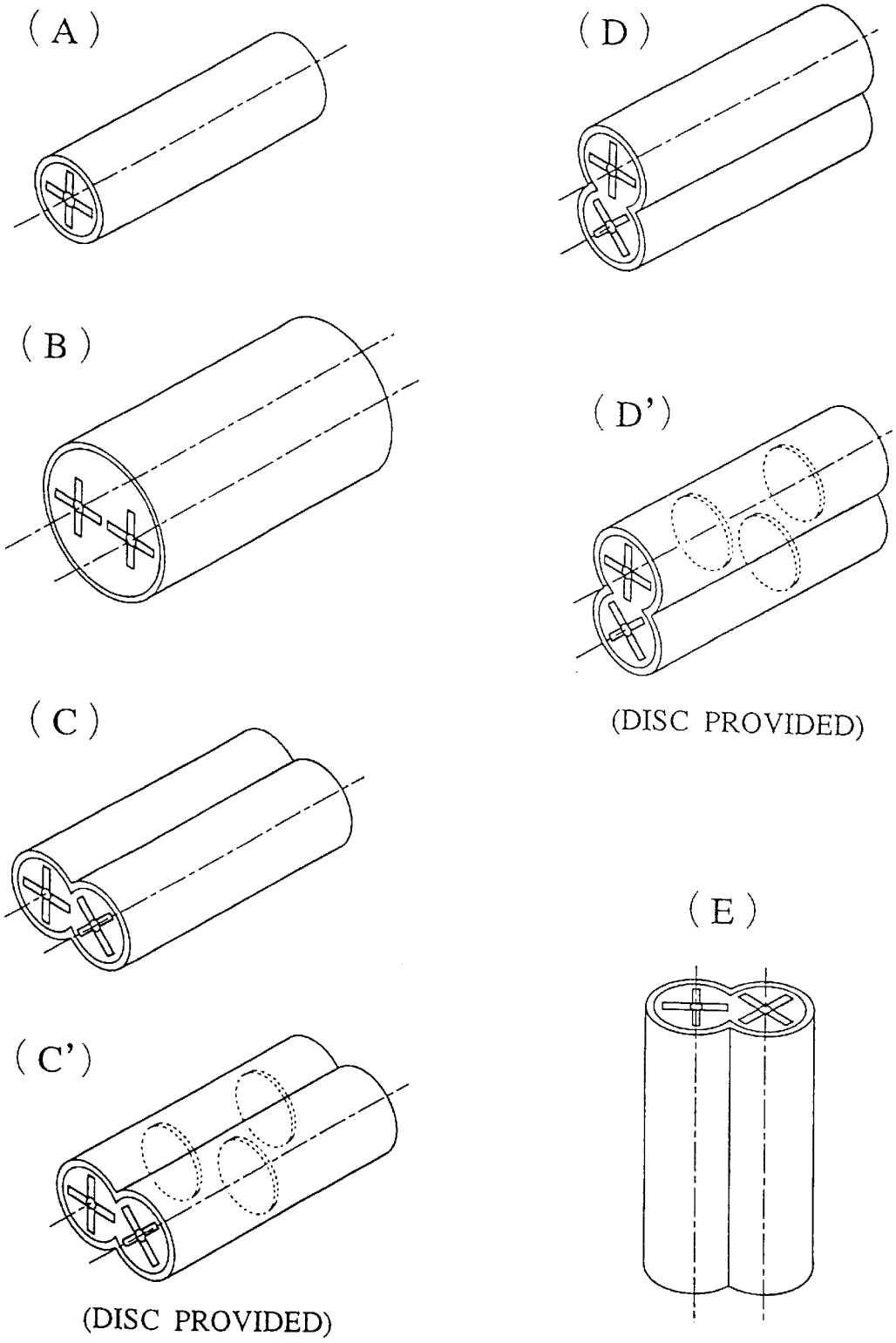
FIG. 6A–E, C', D' is a schematic and conceptual view showing dispersing apparatuses according to a comparative example and the present invention.

Results of experiments performed by using the dispersing apparatuses respectively having structures (A) and (B) according to the comparative examples and those (C), (C'), (D), (D') and (E) according to the present invention and as shown schematically in FIG. 6 are shown in Table 3. A fact was confirmed that the dispersing apparatuses according to the present invention have satisfactorily performed the dispersing process.

Note that symbols indicating the type of the dispersing apparatuses (A), (B), (C), (D), (E), (C') and (D') shown in Table 3 indicate the dispersing apparatuses schematically shown in FIG. 6.

In FIG. 6, the type (A) corresponds to the structure shown in FIG. 7. The type (B) has a structure such that the first and second rotational shafts 5A and 5B are disposed in a horizontal and cylindrical vessel and the rotational regions of the stirring blades 7A and 7B provided for the first and second rotational shaft do not overlap. The types (A) and (B) are structures according to the comparative examples.

The type (C) shown in FIG. 6 has a structure corresponding to the dispersing apparatus structured as shown in FIGS. 1 and 2. The type (D) corresponds to the structure formed by rotating the structure of the type (C) by 90°. The type (E) corresponds to the dispersing apparatus having the structure shown in FIGS. 3 and 4. The type (C') corresponds to the dispersing apparatus shown in FIG. 5 and has a structure such that the disc is provided for the type (C). The type (D') corresponds to a structure such that the structure of the type (C') is rotated by 90° and a disc is provided for the type (D).

TABLE 3

| Examples | Type of Dispersing Apparatuses | Pigment | Particle Size Distribution D50 (μm) | Coloring Power | Luster (%) 20° G | Luster (%) 60° G |
|---|---|---|---|---|---|---|
| Comparative Example 1 | (A) | | 0.31 | 100 | 61.4 | 80.3 |
| Comparative Example 2 | (B) | | 0.30 | 102 | 63.0 | 85.0 |
| Example 1 | (C) | | 0.24 | 118 | 83.5 | 91.5 |
| Example 2 | (D) | C.I.Pigment Blue 15:1 | 0.23 | 120 | 83.7 | 92.0 |
| Example 3 | (E) | (Pthalocyanine Pigment) | 0.28 | 115 | 81.0 | 86.5 |
| Example 3 | (C') | | 0.21 | 120 | 84.3 | 92.0 |
| Example 4 | (D') | | 0.20 | 121 | 84.5 | 92.3 |
| Comparative Example 1 | (A) | | 0.32 | 100 | 55.4 | 78.8 |

TABLE 3-continued

| Examples | Type of Dispersing Apparatuses | Pigment | Particle Size Distribution D50 (μm) | Coloring Power | Luster (%) 20° G | Luster (%) 60° G |
|---|---|---|---|---|---|---|
| Comparative Example 3 | (B) | Quinacridon | 0.30 | 103 | 57.0 | 79.5 |
| Example 6 | (C) | (Quinacridon Pigment) | 0.22 | 115 | 80.6 | 88.4 |
| Example 7 | (D) | | 0.19 | 118 | 80.8 | 88.7 |

Although the invention has been described in its preferred form, the present invention is not limited to the form of the embodiments above and the present disclosure of the preferred form can be changed.

That is, the foregoing embodiments have been described about the structure in which the first and second rotational shafts are rotated in the same directions. Although the first and second rotational shafts may be rotated in opposite directions, it is preferable that they rotate in the same direction. Another structure may be employed in which rotations of the first and second rotational shafts in the same direction and that in the opposite directions are repeated at every arbitrary time.

The structure shown in FIGS. 1 and 3 may be arranged such that a circular arc interrupting plate for preventing linear movement of the material to be dispersed along the inner surface of the vessel is provided for an arbitrary range of the inner surface of the vessel such that the interruption plate slightly projects in the inner direction while preventing interruption of the stirring blades.

In place of the pin type stirring blades provided for the first and second rotational shafts, a plurality of disc type stirring blades may be disposed. In the foregoing case, the disc type stirring blades may have a plurality of through holes each having an arbitrary size and a shape, or the through holes may be omitted. Moreover, the disc type stirring blades each having the through hole and disc type stirring blade having no through holes may be mixed.

In addition, the rotational radii of the first and second stirring blades provided for the first and second rotational shafts may be made to be different.

INDUSTRIAL APPLICABILITY

As can be understood from the description of the embodiments, according to the invention claimed in claim 1, when the first and second rotational shafts are rotated and the material to be dispersed is supplied through the supply port of the vessel, the particle media is stirred by the stirring blades so that the process for dispersing the material is performed. Since the inner surface of the vessel has a shape formed by combining two circular arc curved planes formed along the rotational end of each of the stirring blades provided for the first and second rotational shafts and the portions of the rotational regions of the stirring blades overlap, dead space, in which the particle media cannot easily be stirred, is not generated in the vessel. Since the rotational directions of the first and second rotational shafts are made to be the same, the directions in which the stirring blades are moved are made to be opposite to each other in the region in which the rotational region of the stirring blades overlap. Therefore, the collision of the particle media and rotations of the same together with the rotational shaft can be prevented.

As a result, the process for dispersing the material can effectively be performed, pigment particles in the solvent can furthermore be fined, difference in the concentration can be eliminated and the pigment particles can be made to be uniform.

According to the invention claimed in claim 2, the load of the particle media in the chamber in which the upper rotational shaft is disposed acts on the particle media in the chamber in which the lower rotational shaft is disposed. Moreover, the lower chamber is brought to a state where it is filled with the particle media. Therefore, a further effective dispersing process can be performed.

According to the invention claimed in claim 3, the quantities of the particle media in the chambers in which the first and second rotational shafts are disposed are made to be substantially the same and the material to be dispersed can easily be allowed to meander in each chamber. Thus, the distance for which the material to be dispersed is moved from the supply port to the discharge port can be lengthened and the dispersing process can sufficiently be performed.

According to the invention claimed in claim 4, the positional relationship between the first and second rotational shafts can be varied in the vertical state and the horizontal state. As a result, the characteristics of both of the states are used to effectively perform the dispersing process.

According to the invention claimed in claim 5, the chambers in which the first and second rotational shafts are disposed are vertically disposed so that the quantities of the particle media in the chambers in which the first and second rotational shafts are disposed are made to be substantially the same and the material to be dispersed are easily be allowed to meander in each chamber. As a result, the distance for which the material to be dispersed is moved can be lengthened so that the secondary particles is performed more effectively.

According to the invention claimed in claim 6, the plate-like blade realizes a tendency of preventing movement of the material to be dispersed along the shaft so that meandering of the material to be dispersed is enhanced. As a result, meandering can be performed effectively and the dispersing process can effectively be performed.

According to the invention claimed in claim 7, portions of the rotational regions of the stirring blades provided for the first and second rotational shafts always overlap. Thus, rotations of the particle media together with the stirring blades can be prevented in the overlap portion.

According to the invention claimed in claim 8, clogging of the particle media in the gaps between the first and second rotational shafts and stirring blades and between the stirring blades and the inner surface of the vessel can be prevented. Moreover, deterioration in the dispersing process attributable to the excessively large gap can be prevented.

According to the invention claimed in claim 9, the direction in which the stirring blades are moved are made to be opposite in the position at which the rotational regions of the stirring blades overlap. As a result, rotations of the particle media together with the rotational shafts can effectively be prevented.

We claim:

1. A dispersing apparatus comprising:

a vessel having ports for supplying and discharging a material to be dispersed;

first and second rotational shafts disposed in said vessel to run parallel to each other and rotatively;

a plurality of stirring blades provided, in an axial direction and apart from one another at arbitrary intervals, for said first and second rotational shafts and located alternately in the axial direction; and particle media arranged to perform a process for dispersing said material and enclosed in said vessel; wherein:

portions of rotational regions of said stirring blades provided for said first and second rotational shafts overlap, said vessel has an inner surface formed by combining two circular arc-curved surfaces formed along outer rotational ends of said stirring blades provided for said first and second rotational shafts, said first and second rotational shafts are disposed horizontally, a vertical plane includes axes of said first and second rotational shafts, and assuming that radii of said first and second rotational shafts are rA and rB, rotational radii of each of said stirring blades provided for said first and second rotational shafts are RA and RB, and a distance between axes of said first and second rotational shafts is L, so that a relationship $rB+RA=rA+RB<L\leqq 0.9\ (RA+RB)$ is satisfied.

2. A dispersing apparatus according to claim 1, wherein at least one plate-like blade is provided for at least either of said first and second rotational shafts.

3. A dispersing apparatus according to claim 2, wherein a distance from an outer surface of each of said first and second rotational shafts to the outer rotational outer ends of said stirring blades provided for said first and second rotational shafts and a distance from the outer rotational ends of said stirring blades to the inner surface of said vessel are not less than three times a mean diameter of said particle media nor more than ten times.

4. A dispersing apparatus according to claim 3, wherein rotational directions of said first and second rotational shafts are the same.

5. A dispersing apparatus according to claim 2, wherein rotational directions of said first and second rotational shafts are the same.

6. A dispersing apparatus comprising:

a vessel having ports for supplying and discharging a material to be dispersed;

first and second rotational shafts disposed in said vessel to run parallel to each other and rotatively;

a plurality of stirring blades provided, in an axial direction and apart from one another at arbitrary intervals, for said first and second rotational shafts and located alternately in the axial direction; and particle media arranged to perform a process for dispersing said material and enclosed in said vessel; wherein:

portions of rotational regions of said stirring blades provided for said first and second rotational shafts overlap, said vessel has an inner surface formed by combining two circular arc-curved surfaces formed along outer rotational ends of said stirring blades provided for said first and second rotational shafts, said first and second rotational shafts are disposed horizontally, a vertical plane includes axes of said first and second rotational shafts, and a distance from an outer surface of each of said first and second rotational shafts to the outer rotational ends of said stirring blades provided for said first and second rotational shafts and a distance from the outer rotational ends of said stirring blades to the inner surface of said vessel are not less than three times a mean diameter of said particle media nor more than ten times.

7. A dispersing apparatus according to claim 6, wherein at least one plate-like blade is provided for at least either of said first and second rotational shafts.

8. A dispersing apparatus according to claim 7, wherein rotational directions of said first and second rotational shafts are the same.

9. A dispersing apparatus comprising:

a vessel having ports for supplying and discharging a material to be dispersed;

first and second rotational shafts disposed in said vessel to run parallel to each other and rotatively;

a plurality of stirring blades provided, in an axial direction and apart from one another at arbitrary intervals, for said first and second rotational shafts and located alternately in the axial direction; and particle media arranged to perform a process for dispersing said material and enclosed in said vessel; wherein:

portions of rotational regions of said stirring blades provided for said first and second rotational shafts overlap, said vessel has an inner surface formed by combining two circular arc-curved surfaces formed along outer rotational ends of said stirring blades provided for said first and second rotational shafts, said first and second rotational shafts are disposed horizontally, a vertical plane includes axes of said first and second rotational shafts, and rotational directions of said first and second rotational shafts are the same.

10. A dispersing apparatus according to claim 9, wherein at least one plate-like blade is provided for at least either of said first and second rotational shafts.

11. A dispersing apparatus comprising:

a vessel having ports for supplying and discharging a material to be dispersed;

first and second rotational shafts disposed in said vessel to run parallel to each other and rotatively;

a plurality of stirring blades provided, in an axial direction and apart from one another at arbitrary intervals, for said first and second rotational shafts and located alternately in the axial direction; and particle media arranged to perform a process for dispersing said material and enclosed in said vessel; wherein:

portions of rotational regions of said stirring blades provided for said first and second rotational shafts overlap, said vessel has an inner surface formed by combining two circular arc-curved surfaces formed along outer rotational ends of said stirring blades provided for said first and second rotational shafts, said first and second rotational shafts are disposed horizontally, a horizontal plane includes axes of said first and second rotational shafts, and assuming that radii of said first and second rotational shafts are rA and rB, rotational radii of each of said stirring blades provided for said first and second rotational shafts are RA and RB, and a distance between axes of said first and second rotational shafts is L, so that a relationship $rB+RA=rA+RB<L\leqq 0.9\ (RA+RB)$ is satisfied.

12. A dispersing apparatus according to claim 11, wherein at least one plate-like blade is provided for at least either of said first and second rotational shafts.

13. A dispersing apparatus according to claim 12, wherein a distance from an outer surface of each of said first and second rotational shafts to the outer rotational ends of said stirring blades provided for said first and second rotational shafts and a distance from the outer rotational ends of said stirring blades to the inner surface of said vessel are not less than three times a mean diameter of said particle media nor more than ten times.

14. A dispersing apparatus according to claim 13, wherein rotational directions of said first and second rotational shafts are the same.

15. A dispersing apparatus according to claim 12, wherein rotational directions of said first and second rotational shafts are the same.

16. A dispersing apparatus comprising:

a vessel having ports for supplying and discharging a material to be dispersed;

first and second rotational shafts disposed in said vessel to run parallel to each other and rotatively;

a plurality of stirring blades provided, in an axial direction and apart from one another at arbitrary intervals, for said first and second rotational shafts and located alternately in the axial direction; and particle media arranged to perform a process for dispersing said material and enclosed in said vessel; wherein:

portions of rotational regions of said stirring blades provided for said first and second rotational shafts overlap, said vessel has an inner surface formed by combining two circular arc-curved surfaces formed along outer rotational ends of said stirring blades provided for said first and second rotational shafts, said first and second rotational shafts are disposed horizontally, a horizontal plane includes axes of said first and second rotational shafts, and a distance from an outer surface of each of said first and second rotational shafts to the outer rotational ends of said stirring blades provided for said first and second rotational shafts and a distance from the outer rotational ends of said stirring blades to the inner surface of said vessel are not less then three times a mean diameter of said particle media nor more than ten times.

17. A dispersing apparatus according to claim 16, wherein at least one plate-like blade is provided for at least either of said first and second rotational shafts.

18. A dispersing apparatus according to claim 17, wherein rotational directions of said first and second rotational shafts are the same.

19. A dispersing apparatus comprising:

a vessel having ports for supplying and discharging a material to be dispersed;

first and second rotational shafts disposed in said vessel to run parallel to each other and rotatively;

a plurality of stirring blades provided, in an axial direction and apart from one another at arbitrary intervals, for said first and second rotational shafts and located alternately in the axial direction; and particle media arranged to perform a process for dispersing said material and enclosed in said vessel; wherein:

portions of rotational regions of said stirring blades provided for said first and second rotational shafts overlap, said vessel has an inner surface formed by combining two circular arc-curved surfaces formed along the outer rotational ends of said stirring blades provided for said first and second rotational shafts, said first and second rotational shafts are disposed horizontally, a horizontal plane includes axes of said first and second rotational shafts, and rotational directions of said first and second rotational shafts are the same.

20. A dispersing apparatus according to claim 19, wherein at least one plate-like blade is provided for at least either of said first and second rotational shafts.

21. A dispersing apparatus comprising:

a vessel having ports for supplying and discharging a material to be dispersed;

first and second rotational shafts disposed in said vessel to run parallel to each other and rotatively;

a plurality of stirring blades provided, in an axial direction and apart from one another at arbitrary intervals, for said first and second rotational shafts and located alternately in the axial direction; and particle media arranged to perform a process for dispersing said material and enclosed in said vessel; wherein:

portions of rotational regions of said stirring blades provided for said first and second rotational shafts overlap, said vessel has an inner surface formed by combining two circular arc-curved surfaces formed along outer rotational ends of said stirring blades provided for said first and second rotational shafts, said first and second rotational shafts are disposed horizontally, said shafts can be changed between a vertical state and a horizontal state, and assuming that radii of said first and second rotational shafts are rA and rB, rotational radii of each of said stirring blades provided for said first and second rotational shafts are RA and RB, and a distance between axes of said first and second rotational shafts is L, so that a relationship $rB+RA=rA+RB<L\leqq 0.9\ (RA+RB)$ is satisfied.

22. A dispersing apparatus according to claim 21, wherein at least one plate-like blade is provided for at least either of said first and second rotational shafts.

23. A dispersing apparatus according to claim 22, wherein a distance from an outer surface of each of said first and second rotational shafts to the outer rotational ends of said stirring blades provided for said first and second rotational shafts and a distance from the outer rotational ends of said stirring blades to the inner surface of said vessel are not less than three times a mean diameter of said particle media nor more than ten times.

24. A dispersing apparatus according to claim 23, wherein rotational directions of said first and second rotational shafts are the same.

25. A dispersing apparatus according to claim 22, wherein rotational directions of said first and second rotational shafts are the same.

26. A dispersing apparatus comprising:

a vessel having ports for supplying and discharging a material to be dispersed;

first and second rotational shafts disposed in said vessel to run parallel to each other and rotatively;

a plurality of stirring blades provided, in an axial direction and apart from one another at arbitrary intervals, for said first and second rotational shafts and located alternately in the axial direction, and particle media arranged to perform a process for dispersing said material and enclosed in said vessel; wherein:

portions of rotational regions of said stirring blades provided for said first and second rotational shafts overlap, said vessel has an inner surface formed by combining two circular arc-curved surfaces formed along outer rotational ends of said stirring blades provided for said first and second rotational shafts, said first and second rotational shafts are disposed horizontally, said shafts can be changed between a vertical state and a horizontal state, and a distance from an outer surface of each of said first and second rotational shafts to the outer rotational ends of said stirring blades provided for said first and second rotational shafts and a distance from the outer rotational ends of said stirring blades to the inner surface of said vessel are not less then three times a mean diameter of said particle media nor more than ten times.

27. A dispersing apparatus according to claim 26, wherein at least one plate-like blade is provided for at least either of said first and second rotational shafts.

28. A dispersing apparatus according to claim 27, wherein rotational directions of said first and second rotational shafts are the same.

29. A dispersing apparatus comprising:

a vessel having ports for supplying and discharging a material to be dispersed;

first and second rotational shafts disposed in said vessel to run parallel to each other and rotatively;

a plurality of stirring blades provided, in an axial direction and apart from one another at arbitrary intervals, for said first and second rotational shafts and located alternately in the axial direction; and particle media arranged to perform a process for dispersing said material and enclosed in said vessel; wherein:

portions of rotational regions of said stirring blades provided for said first and second rotational shafts overlap, said vessel has an inner surface formed by combining two circular arc-curved surfaces formed along outer rotational ends of said stirring blades provided for said first and second rotational shafts, said first and second rotational shafts are disposed horizontally, said shafts can be changed between a vertical state and a horizontal state, and rotational directions of said first and second rotational shafts are the same.

30. A dispersing apparatus according to claim 29, wherein at least one plate-like blade is provided for at least either of said first and second rotational shafts.

* * * * *